US012774577B2

(12) United States Patent
Perko et al.

(10) Patent No.: US 12,774,577 B2
(45) Date of Patent: Oct. 27, 2026

(54) TOWER BASE FOR PILING FOUNDATION

(71) Applicant: Magnum Piering, Inc., West Chester, OH (US)

(72) Inventors: Howard A. Perko, Fort Collins, CO (US); Steve A. Babcock, Loveland, CO (US); Karla R. Myers, Fort Collins, CO (US); Todd Paddock, Mainville, OH (US); Brian J. Dwyer, Loveland, OH (US); Bernard Dwyer, Jr., Loveland, OH (US); Melinda Hummel, Berthoud, CO (US); Kevin Baumgartner, Fort Collins, CO (US)

(73) Assignee: Magnum Piering, Inc., West Chester, OH (US)

( * ) Notice: Subject to any disclaimer, the term of this patent is extended or adjusted under 35 U.S.C. 154(b) by 192 days.

(21) Appl. No.: 18/051,687

(22) Filed: Nov. 1, 2022

(65) Prior Publication Data

US 2023/0140266 A1 May 4, 2023

Related U.S. Application Data

(60) Provisional application No. 63/275,694, filed on Nov. 4, 2021.

(51) Int. Cl.

| | |
|---|---|
| ***E02D 27/42*** | (2006.01) |
| ***E02D 5/22*** | (2006.01) |
| ***E02D 5/56*** | (2006.01) |
| ***E02D 27/01*** | (2006.01) |
| ***E02D 27/12*** | (2006.01) |
| ***E04H 12/08*** | (2006.01) |
| ***E04H 12/22*** | (2006.01) |

(52) U.S. Cl.

CPC ..... *E02D 27/42* (2013.01); *E02D 27/12* (2013.01); *E02D 5/22* (2013.01); *E02D 5/56* (2013.01); *E02D 27/01* (2013.01); *E02D 2200/115* (2013.01); *E04H 12/085* (2013.01); *E04H 12/2261* (2013.01)

(58) Field of Classification Search

CPC ... E02D 27/42; E02D 27/12; E02D 2200/115; E02D 27/01; E02D 5/22; E02D 5/56; E04H 12/2261; E04H 12/085

See application file for complete search history.

(56) References Cited

U.S. PATENT DOCUMENTS 4,295,308 A * 10/1981 Korfanta ..... E04H 12/2261 248/158
4,890,959 A * 1/1990 Robishaw ..... B63B 35/38 405/196

(Continued)

*Primary Examiner* — Omar F Hijaz
(74) *Attorney, Agent, or Firm* — Wood Herron & Evans LLP

(57) ABSTRACT

A base structure for a piling foundation is provided. The base structure includes an upper plate and a lower plate. The lower plate is spaced a distance below the upper plate and is oriented substantially parallel to the upper plate. Both the upper plate and the lower plate include a number of plate apertures therethrough. The upper plate and the lower plate are connected to each other by webs configured to provide structural integrity to the base structure. Further, a piling foundation assembly for supporting operating equipment and a method for installing a piling foundation assembly are provided.

7 Claims, 12 Drawing Sheets

(56) References Cited

U.S. PATENT DOCUMENTS

| | | | | |
|---|---|---|---|---|
| 6,094,873 | A * | 8/2000 | Hoffman | E02D 27/01 52/294 |
| 8,109,057 | B2 * | 2/2012 | Stark | E04H 12/2215 52/165 |
| 9,091,037 | B2 * | 7/2015 | Fairbairn | H01Q 1/1242 |
| 9,365,998 | B2 | 6/2016 | Perko | |
| 10,138,615 | B2 | 11/2018 | Kim et al. | |
| 10,767,334 | B2 | 9/2020 | Perko et al. | |
| 11,408,175 | B2 * | 8/2022 | Faries | E04C 3/30 |
| 2007/0028533 | A1 * | 2/2007 | Stroyer | E01D 15/133 52/489.1 |
| 2007/0280787 | A1 * | 12/2007 | Snyder | E02D 31/02 405/229 |
| 2009/0279959 | A1 * | 11/2009 | Bakos | E02D 27/42 405/231 |

* cited by examiner

TOWER BASE FOR PILING FOUNDATION

CROSS-REFERENCE TO RELATED APPLICATION

This application is related to and claims priority to U.S. Provisional Patent Application Ser. No. 63/275,694, filed on Nov. 4, 2021, the entire contents of which are herein incorporated by reference.

TECHNICAL FIELD

This application relates generally to piling foundations, and, more specifically, to a base structure or "grillage" for mounting equipment, for example, to a multi-pile foundation.

BACKGROUND

Power transmission lines often extend for long distances across remote and sometimes rugged terrain. Transmission lines are suspended on power transmission towers installed at intervals along the length of the power transmission lines. Traditionally, power transmission towers are wooden poles sunk into holes in the soil or metal structures situated on concrete foundations, for example. Moving equipment into remote and rugged locations to construct and install traditional foundations for power transmission towers presents many challenges. Thus, it would be desirable to provide a base structure for power transmission towers, for example, that avoids, alleviates, or otherwise minimizes known issues associated with traditional foundations.

SUMMARY OF THE INVENTION

Certain exemplary aspects of the invention are set forth below. It should be understood that these aspects are presented merely to provide the reader with a brief summary of certain forms the invention might take and that these aspects are not intended to limit the scope of the invention.

In a first set of embodiments of the invention, a base structure for a piling foundation is provided. The base structure includes an upper plate and a lower plate. The lower plate is spaced a distance below the upper plate and is oriented substantially parallel to the upper plate. The base structure also includes a number of webs. The number of webs connect the upper plate and the lower plate and are configured to add structural integrity to the base structure. Further, the upper plate and the lower plate each include a number of plate apertures therethrough.

In one embodiment, the number of webs may be cylindrical webs, radial webs, tangential webs, and/or angled webs. Further, the upper plate and the lower plate may include a number of equipment apertures. Each equipment aperture may be configured to receive a fastener for securing operating equipment to the base structure.

In another embodiment, the upper plate and the lower plate may be substantially square-shaped and each of the upper plate and the lower plate may include four plate apertures. Alternatively, the upper plate and the lower plate may be substantially circle-shaped and each of the upper plate and the lower plate may include eight plate apertures.

In yet another embodiment, the upper plate and the lower plate may be formed of steel. Further, the number of webs may be formed of steel and may be welded to the upper plate and to the lower plate.

In another set of embodiments of the invention, a piling foundation assembly for supporting operating equipment is provided. The assembly includes a number of piles installed into a ground. Each pile of includes a free end that extends above the ground. The assembly also includes a base structure configured to support the operating equipment. The base structure includes an upper plate and a lower plate. The lower plate is spaced a distance below the upper plate. The base structure also includes a number of webs. The number of webs connect the upper plate and the lower plate. The base structure is attached to the free ends of the piles.

In one embodiment, each pile may further include a pile cap coupled to the free end of the pile. The pile cap may include a receiving sleeve, configured to surround and receive the free end of the pile, and a cap plate, affixed atop the receiving sleeve and configured to receive the base structure thereon. Further, the upper plate and the lower plate may each include at least one plate aperture therethrough. Each cap plate may also include a cap plate aperture. Additionally, a fastening member may be threaded through the cap plate aperture, the at least one plate aperture of the lower plate, and the at least one plate aperture of the upper plate to attach the base structure to the pile. Furthermore, at least one washer may be positioned around the fastening member above the at least one plate aperture of the upper plate to aid in attaching the base structure and to the pile.

In another embodiment, the upper plate and the lower plate may include a number of equipment apertures. Each equipment aperture may be configured to receive a fastener for securing the operating equipment to the base structure. Further, the operating equipment may be a power transmission tower or a portion thereof.

In a further set of embodiments of the invention, a method of installing a piling foundation assembly is provided. The method includes installing a number of piles into a ground. Each pile includes a free end that extends above the ground. The method further includes coupling a number of pile caps to the free ends of the number of piles. Each pile cap includes a cap plate. The method also includes positioning a base structure on top of the pile caps such that a lower plate of the base structure contacts the cap plates of the respective pile caps. The method additionally includes securing the base structure to the piles.

In one embodiment, the number of piles may be installed into the ground substantially vertically. Further, the piles may be helical piles. Additionally, the method may also include trimming the free end of one or more of the piles such that the respective free ends of the piles extend to substantially the same height above the ground.

In another embodiment, the step of coupling the pile caps may further include securing the pile cap to the pile by threading a fastening member through a receiving sleeve of the pile cap and through the free end of the pile. Additionally, the step of securing the base structure may further include threading a fastening member through a cap plate aperture of the cap plate and through at least one plate aperture of the base structure.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Various additional features and advantages of the invention will become more apparent to those of ordinary skill in the art upon review of the following detailed description of one or more illustrative embodiments taken in conjunction with the accompanying drawings and pictorial views. The accompanying drawings and pictorial views, which are incorporated in and constitute a part of this specification, illustrate one or more embodiments of the invention and, together with the general description given above and the detailed description given below, serve to explain the one or more embodiments of the invention. Like reference numerals are used to indicate like parts throughout the accompanying drawings and pictorial views.

DETAILED DESCRIPTION

Figure 1:
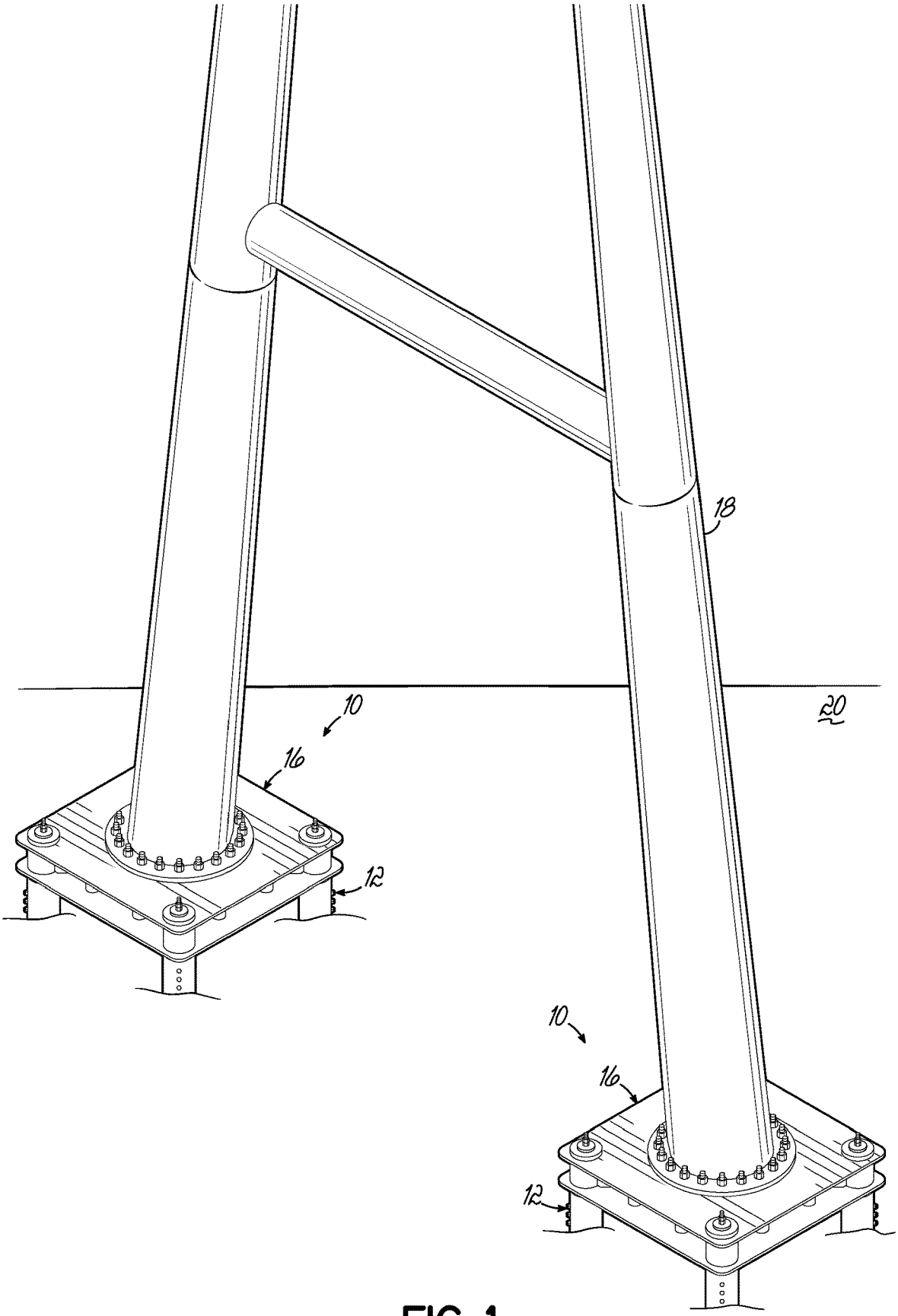
FIG. 1 is an environmental pictorial view of a first embodiment of a base structure.

The exemplary embodiments described herein are provided for illustrative purposes and are not limiting. Other exemplary embodiments are possible, and modifications may be made to the exemplary embodiments within the scope of the present disclosure. Therefore, this detailed description is not meant to limit the scope of the present disclosure.

With general reference to FIGS. 1-19, a piling foundation assembly 10 or portions thereof in accordance with embodiments of the invention are shown. As set forth in greater detail below, the present invention provides a piling foundation assembly 10 including a base structure 16 that can be prefabricated and then mounted on a plurality of piles 12 to create a foundation for operating equipment 18 (e.g., a power transmission tower). The base structure 16 can receive vertical or angled operating equipment 18 to support power transmission lines or power substation equipment, for example. Installation of piles 12 (e.g., helical piles) to support the base structure 16 is less destructive to the environment and requires less invasive equipment to be moved to the site to install in comparison to traditional (e.g., concrete) foundations. For example, no field welding is required, so a pile 12 can be installed in any weather conditions and is more easily removable. Thus, the present invention provides a base structure 16 for operating equipment 18 (e.g., power transmission towers) that avoids, alleviates, or otherwise minimizes known issues with traditional foundations. The elements and features of the piling foundation assembly 10 are set forth in further detail below to clarify the functional advantages and other benefits of the invention.

Referring now to FIGS. 1-9, a first embodiment of a piling foundation assembly 10 is shown. The piling foundation assembly 10 generally includes a plurality of piles 12, a plurality of pile caps 14 affixed to the piles 12, and a base structure 16 situated atop and attached to the pile caps 14. Operating equipment 18 (shown in FIG. 1, for example) is supported atop the base structure 16 above the ground 20. In the depicted embodiment, the operating equipment 18 is a power transmission tower (e.g., for supporting high-voltage power lines). It will be appreciated that other types of operating equipment 18 could also be supported by the base structure 16. For example, the operating equipment 18 could instead be a pole or tower for supporting a portion of a power-generation substation.

Referring specifically to FIGS. 1-4, each pile 12 is installed deep into the ground 20 such that a free end 22 of the pile 12 extends above the ground 20. Particularly, the piles 12 are installed deep enough in the ground 20 to provide effective support for the base structure 16 and the operating equipment 18 mounted to the base structure 16. In the depicted embodiment, the piles 12 are installed into the ground 20 so as to have a generally vertical orientation. However, piles 12 could alternatively be installed into the ground 20 at an angle to the vertical, such as at 30° to vertical. Further, the piles 12 may be installed into the ground 20 splayed outwardly at an angle away from the base structure 16. Alternatively, the piles 12 may be installed into the ground 20 at angles to the vertical, but in opposing directions with respect to each other. The installed piles 12 may be helical piles, which include helically-arranged blades for engaging the ground. Helical piles can be particularly advantageous when used in conjunction with some specific operating equipment 18 and/or installation environments (e.g., particular local geology). It will be appreciated that the principles of the present invention are also generally applicable to other pile installation configurations and other pile types (e.g., driven piles).

Each pile 12 has a pile cap 14 coupled to a free end 22 (e.g., the end of the pile 12 that extends above the ground 20) thereof. The pile cap 14 may include a cap plate 24 and a receiving sleeve 26. The cap plate 24 is secured to the top of the receiving sleeve 26. The receiving sleeve 26 fits around (e.g., "receives") a free end 22 of a pile 12 when a pile cap 14 is coupled to a pile 12. The pile cap 14 may be secured to a pile 12 in a number of ways. For example, the receiving sleeve 26 of a pile cap 14 may include one or more sleeve apertures 28 and the free end 22 of a pile 12 may include one or more corresponding pile apertures 30 that extend transversely through the free end 22 of the pile 12. The receiving sleeve 26 may be secured to the pile 12 by a fastening member 32, such as a bolt or similar mechanical fastener, that is inserted through (e.g., received in) aligned sleeve apertures 28 and pile apertures 30.

With continued reference to FIGS. 1-4, the cap plates 24 of the pile caps 14 are disposed in a generally horizontal orientation when the pile caps 14 are coupled to the free ends 22 of the piles 12. In other words, the cap plates 24 are oriented generally transverse to the lengthwise axis of the respective piles 12. Moreover, the cap plates 24 are disposed in generally the same horizontal plane as each other. Thus, the cap plates 24 provide a plurality of generally horizontal (e.g., level), coplanar locations for supporting the base structure 16. Pile caps 14 are coupled to the free ends 22 of the piles 12 before the base structure 16 is positioned on top of the pile caps 14. In some instances, it may be necessary to trim a free end 22 of a pile 12 before coupling a pile cap 14 to the pile 12. For example, after piles 12 are installed into the ground 20, the various free ends 22 of the piles 12 may be at different heights and require trimming so that all the free ends 22 extend to generally the same height above the ground 20. After trimming, the pile caps 14 may be coupled to the free ends 22. The base structure 16 then may be situated atop (e.g., rest on) and secured to the piles 12 by the pile caps 14.

Figure 4:
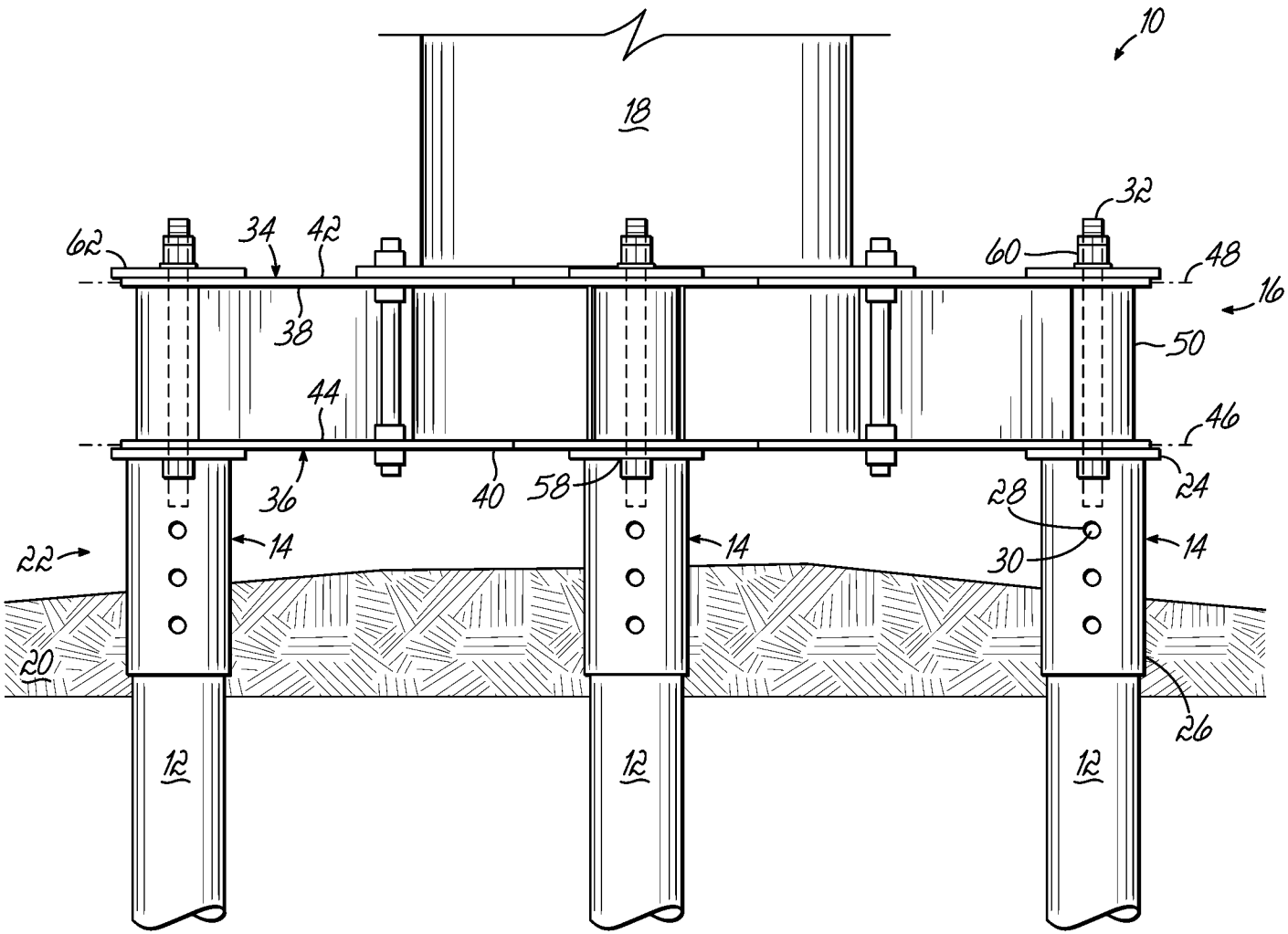
FIG. 4 is a side elevation view of the base structure of FIG. 1.
Figure 6:
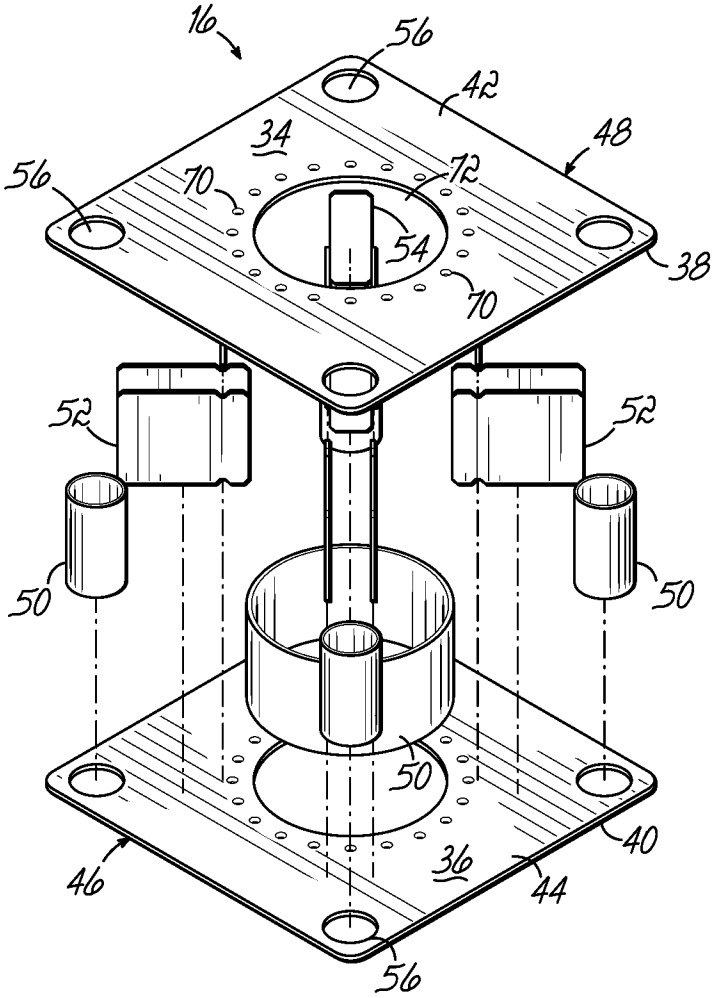
FIG. 6 is an exploded isometric view of the base structure of FIG. 1.
Figure 5:
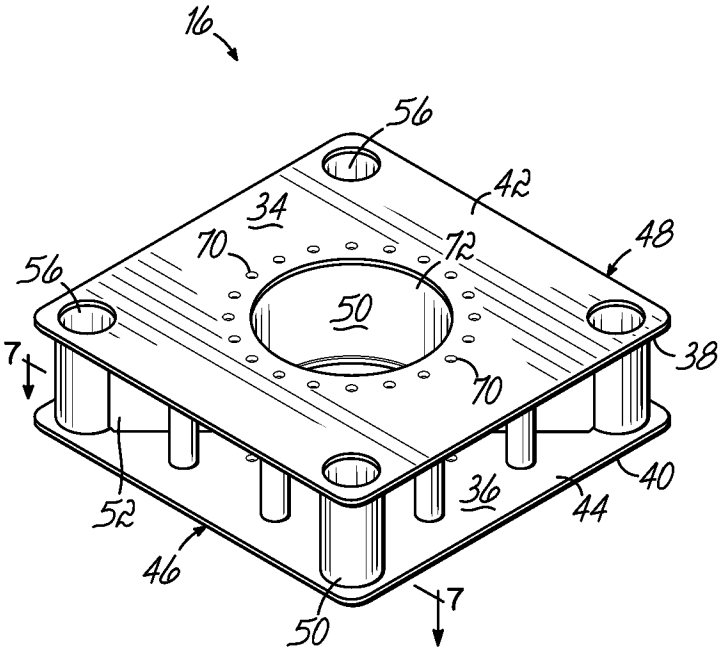
FIG. 5 is an isometric view of the base structure of FIG. 1.
Figure 8:
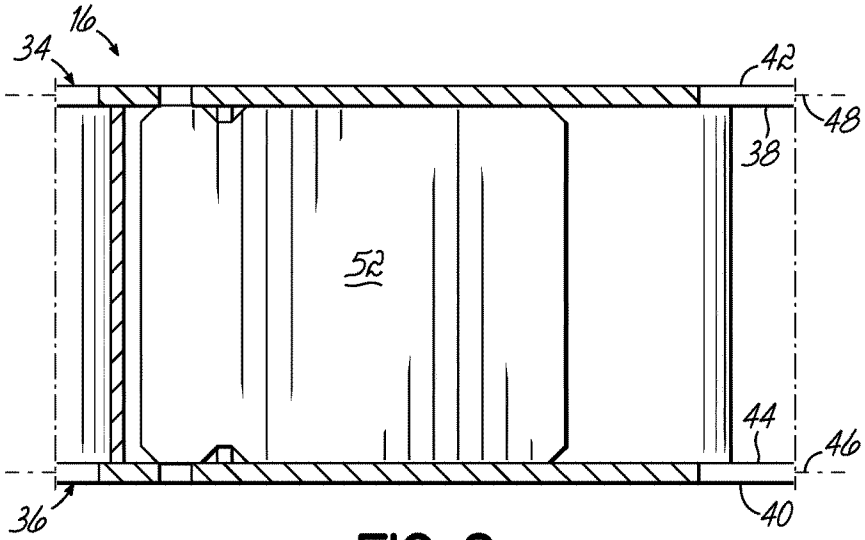
FIG. 8 is a sectional view of the base structure of FIG. 1 taken along line 8-8 of FIG. 7.
Figure 9:
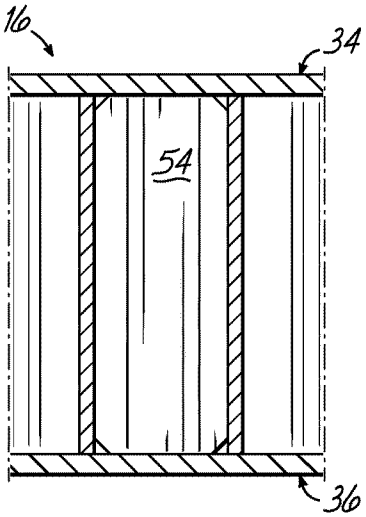
FIG. 9 is a further sectional view of the base structure of FIG. 1 taken along line 9-9 of FIG. 7.
Figure 7:
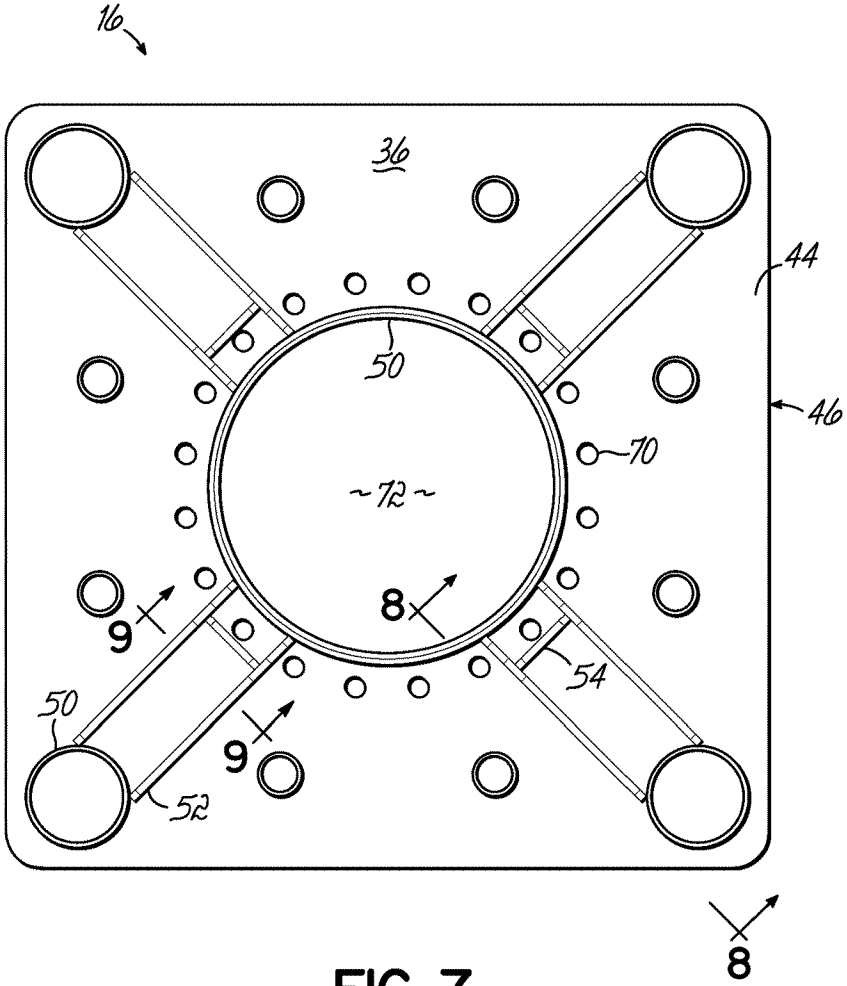
FIG. 7 is a cross-sectional view of the base structure of FIG. 1 taken along line 7-7 of FIG. 5.

Referring now to FIGS. 5-9, the base structure 16 includes an upper plate 34 and a lower plate 36. The upper and lower plates 34, 36 are spaced apart and are oriented generally parallel to each another. The upper and lower plates 34, 36 include respective lower surfaces 38, 40 and upper surfaces 42, 44. Specifically, the upper plate 34 includes lower surface 38 and upper surface 42. The lower plate 36 includes lower surface 40 and upper surface 44. The lower surface 40 of the lower plate 36 defines a lower plane 46 of the base structure 16 and the upper surface 42 of the upper plate 34 defines an upper plane 48 of the base structure 16. As shown in FIG. 4, for example, the upper and lower plates 34, 36 have a general planar configuration. The upper and lower plates 34, 36 may be formed of steel or a similar suitable material. It is to be understood that the upper and lower plates 34, 36 could have alternative configurations and could be formed of alternative materials.

The base structure 16 also includes a plurality of webs 50, 52, 54 that are positioned generally between the upper plate 34 (e.g., upper plane 48) and the lower plate 36 (e.g., lower plane 46), and may be formed of steel or a similar suitable material. The webs 50, 52, 54 may be fixedly attached to the upper and lower plates 34, 36, such as by welding or similar rigid attachment. Specifically, the webs 50, 52, 54 are secured (e.g., by welding) to the upper surface 44 of the lower plate 36 and to the lower surface 38 of the upper plate 34. The plurality of webs 50, 52, 54 may include cylindrical webs 50 (shown in FIGS. 6 and 7, for example), radial webs 52 (shown in FIGS. 6 and 7, for example), and tangential webs 54 (shown in FIGS. 6 and 7, for example). It is to be understood that the webs may take on other shapes and orientations. Further, the webs 50, 52, 54 may be formed of steel or a similar suitable material.

Referring now to FIGS. 4-9, the upper and lower plates 34, 36 include a plurality of plate apertures 56. The space between the plate apertures 56 of the upper plate 34 and the plate apertures 56 of the lower plate 36 may be surrounded by a cylindrical web 50 or other structure (shown in FIGS. 5 and 6, for example). Further, each cap plate 24 includes a cap plate aperture 58 (shown in phantom in FIG. 4, for example). The cap plates 24 and upper and lower plates 34, 36 are secured together by fastening members 32 received in aligned cap plate apertures 58 and plate apertures 56. The fastening member 32 passes through the cap plate aperture 58 of the cap plate 24, a plate aperture 56 in the lower plate 36, and a plate aperture 56 in the upper plate 34. A threaded member 60 (e.g., a nut) may be attached to the fastening member 32 at or near the cap plate 24 of the pile cap 14 to further secure the base structure 16 to the pile 12. An additional threaded member 60 may be fixedly attached to the pile cap 14 (e.g., the cap plate 24), such as by welding, so as to be aligned with the cap plate aperture 58. A fastening member 32 extending through the cap plate aperture 58 may then be threaded into the threaded member 60 attached to the cap plate 24.

Figure 2:
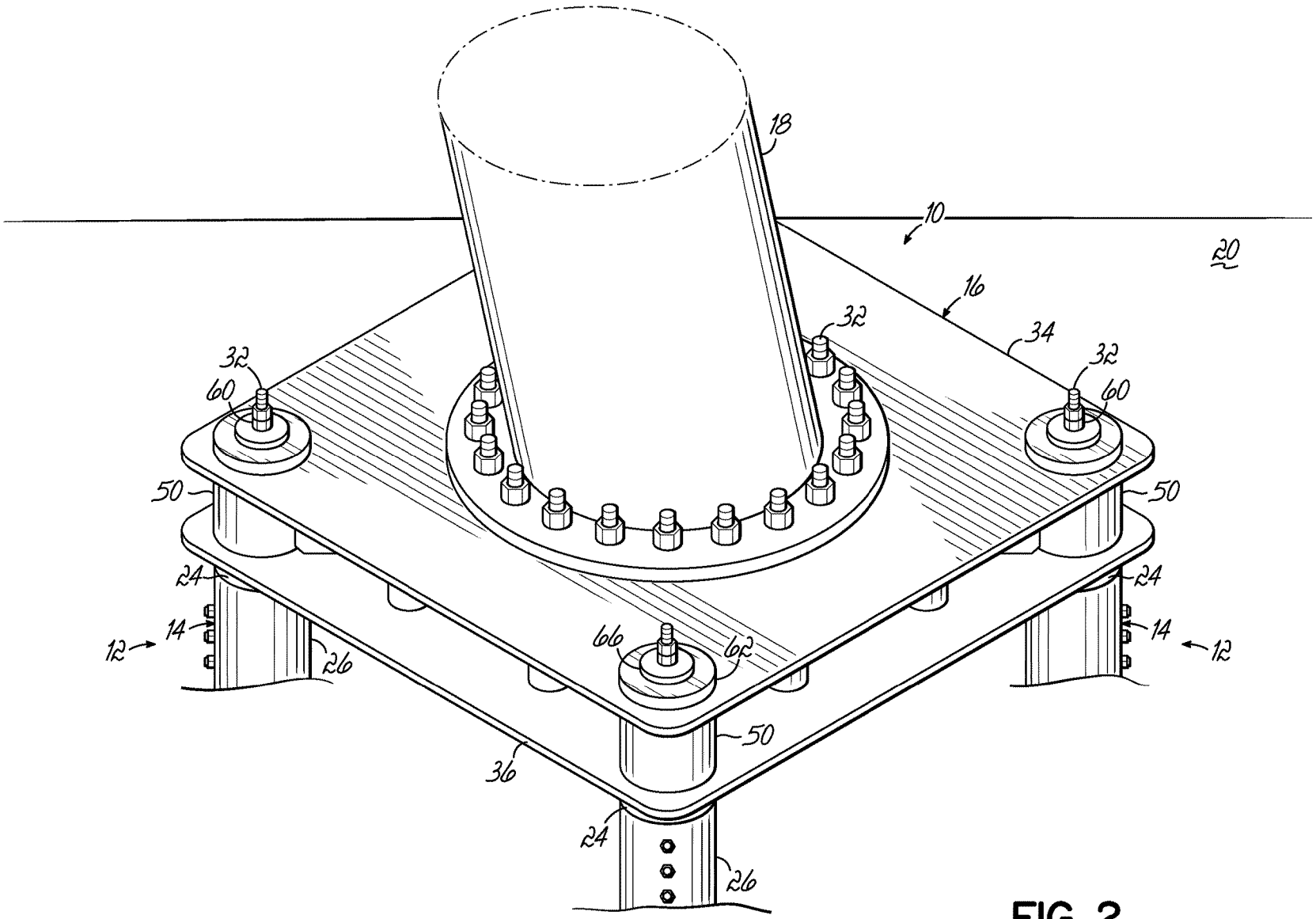
FIG. 2 is a close-up pictorial view of the base structure of FIG. 1.
Figure 3:
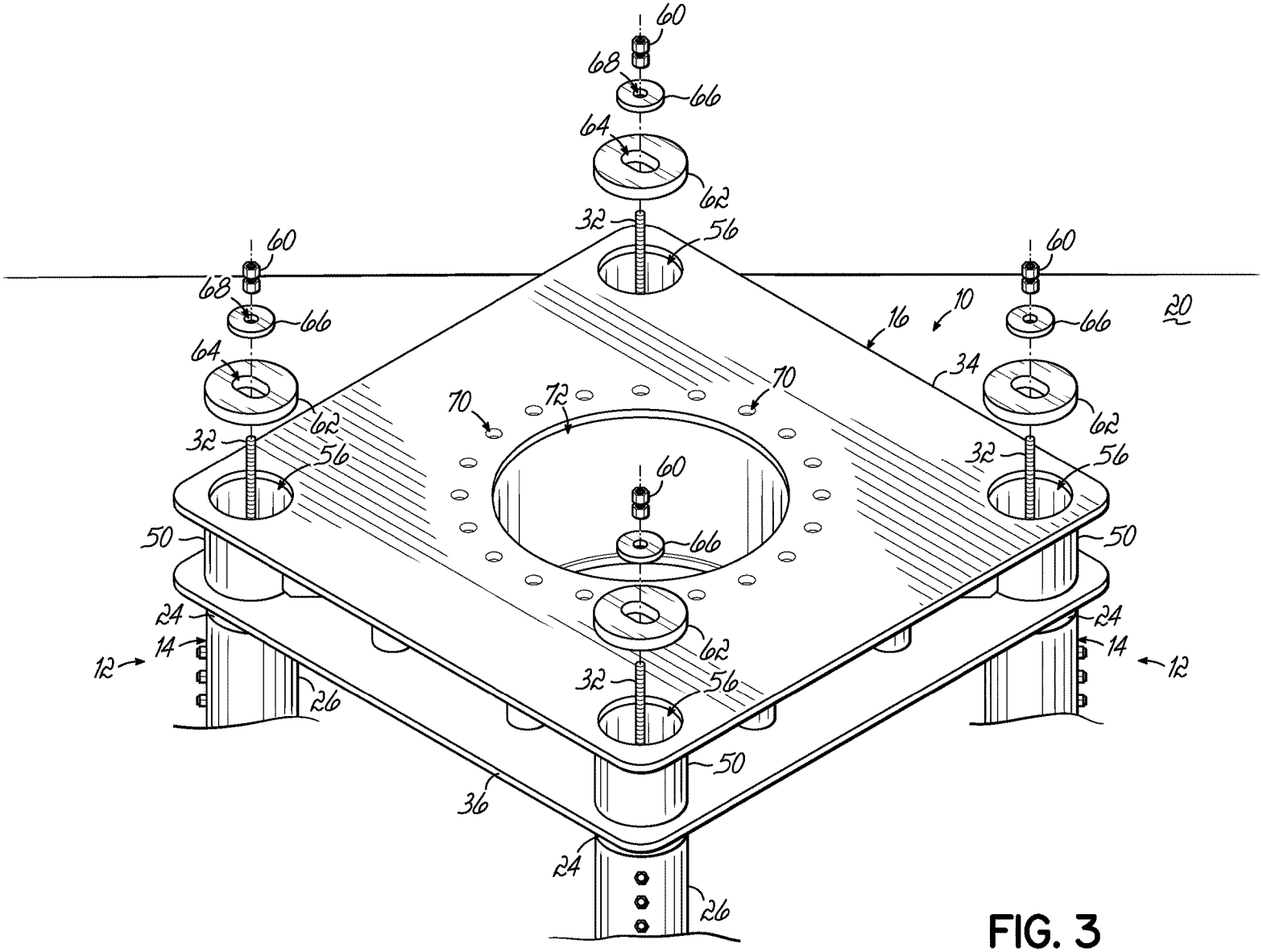
FIG. 3 is a close-up pictorial view of the base structure of FIG. 1, with the operating equipment removed for illustrative purposes.

Referring now to FIGS. 2-4, a slotted washer 62 having a slot 64 may be positioned around the fastening member 32 above a plate aperture 56 of the upper plate 34, and a threaded member 60 may be threaded onto the fastening member 32 above the slotted washer 62 (as shown in FIG. 2, for example). Optionally, an additional washer 66 with a central aperture 68 can be stacked on top of the slotted washer 62 before the threaded member 60 is threaded on the fastening member 32. The slotted washer 62 and the washer 66 allow for forces imparted on the base structure 16 to be distributed along the base structure 16 and to the piles 12 extending therefrom. Advantageously, the plate apertures 56 may be oversized relative to the fastening member 32, such as being elongated in one or more axes transverse to the fastening member 32, to aid in the alignment and securing of the base structure 16 to a the pile 12. The combination of an oversized plate aperture 56 with both a slotted washer 62 and a washer 66 allows for some error in the positioning of the fastening member 32 through the cap plate aperture 58 of the cap plate 24, the plate aperture 56 in the lower plate 36, and the plate aperture 56 in the upper plate 34. For example, the base structure 16 can be secured to the pile 12 without the base structure 16 and the pile 12 being perpendicular to each other at least in part because of the "wiggle room" afforded by the oversized plate apertures 56, slotted washers 62, and washers 66.

Referring now to FIGS. 3-7, both the upper and lower plates 34, 36 of the base structure 16 include a number equipment apertures 70 that are configured to receive a fastening member 32, such as a bolt or similar, for securing the operating equipment 18 to the base structure 16. For example, the operating equipment 18 may be secured to the base structure 16 by fastening members 32 received in the equipment apertures 70. Further, both the upper and lower plates 34, 36 include an equipment opening 72 configured to receive the operating equipment 18 or a part thereof (shown in FIG. 3, for example). Like the plate apertures 56, the space between the equipment openings 72 in the upper and lower plates 34, 36 may be surrounded by a cylindrical web 50 or other similar structure.

Different numbers of piles 12 could be used depending on the nature of the operating equipment 18 and the installation environment (e.g., geology of the location). Specifically, FIGS. 1-9 show an embodiment of a square-shaped base structure 16 for use with four piles 12. The base structure 16 of FIGS. 1-9 includes a number of cylindrical webs 50, radial webs 52, and tangential webs 54. The webs 50, 52, 54 add strength and structural integrity to the base structure 16—particularly, torsional strength to prevent (or at least reduce the likelihood of) the base structure 16 twisting under the load (e.g., bending moment) applied by the operating equipment 18.

Further alternative base structure 16 embodiments are contemplated. The size and shape of the base structure 16 as well as the number of piles 12 employed therewith can vary. For example, a triangular base structure 16 for use with three piles 12 could be employed, a pentagonal base structure 16 for use with five piles 12 could be employed, a hexagonal base structure 16 for use with six piles 12 could be employed, and so on. Generally, base structures 16 could be in the shape of a (regular) polygon of n-sides with a corresponding n-number of piles 12. The piles 12 may be arranged at or near to the vertices of the polygonal base structure 16. Further variations on size and shape of the base structure 16 as well as the number of piles 12 employed therewith beyond those shown in FIGS. 1-9 and those described above are contemplated.

Particularly, FIGS. 10-19 show an embodiment of a circular base structure 16 for use with eight piles 12. The base structure 16 of FIGS. 10-19 includes a number of cylindrical webs 50, radial webs 52, tangential webs 54, and angled webs 55. Like with the embodiment shown in FIGS. 1-9, the webs 50, 52, 54, 55 of the embodiment shown in FIGS. 10-19 add strength and structural integrity to the base structure 16. However, the embodiment depicted in FIGS. 10-19 includes features angled webs 55, which are not featured in the embodiment depicted in FIGS. 1-9. Further alternative base structure 16 embodiments may include a number of webs 50, 52, 54, 55 including cylindrical webs 50, radial webs 52, tangential webs 54, and angled webs 55. A base structure 16 for use with a larger number of piles 12 (for heavier operating equipment 18, for example) may feature more webs 50, 52, 54, 55 than a base structure 16 for use with a smaller number of piles 12 (for lighter operating equipment 18, for example).

Figure 10:
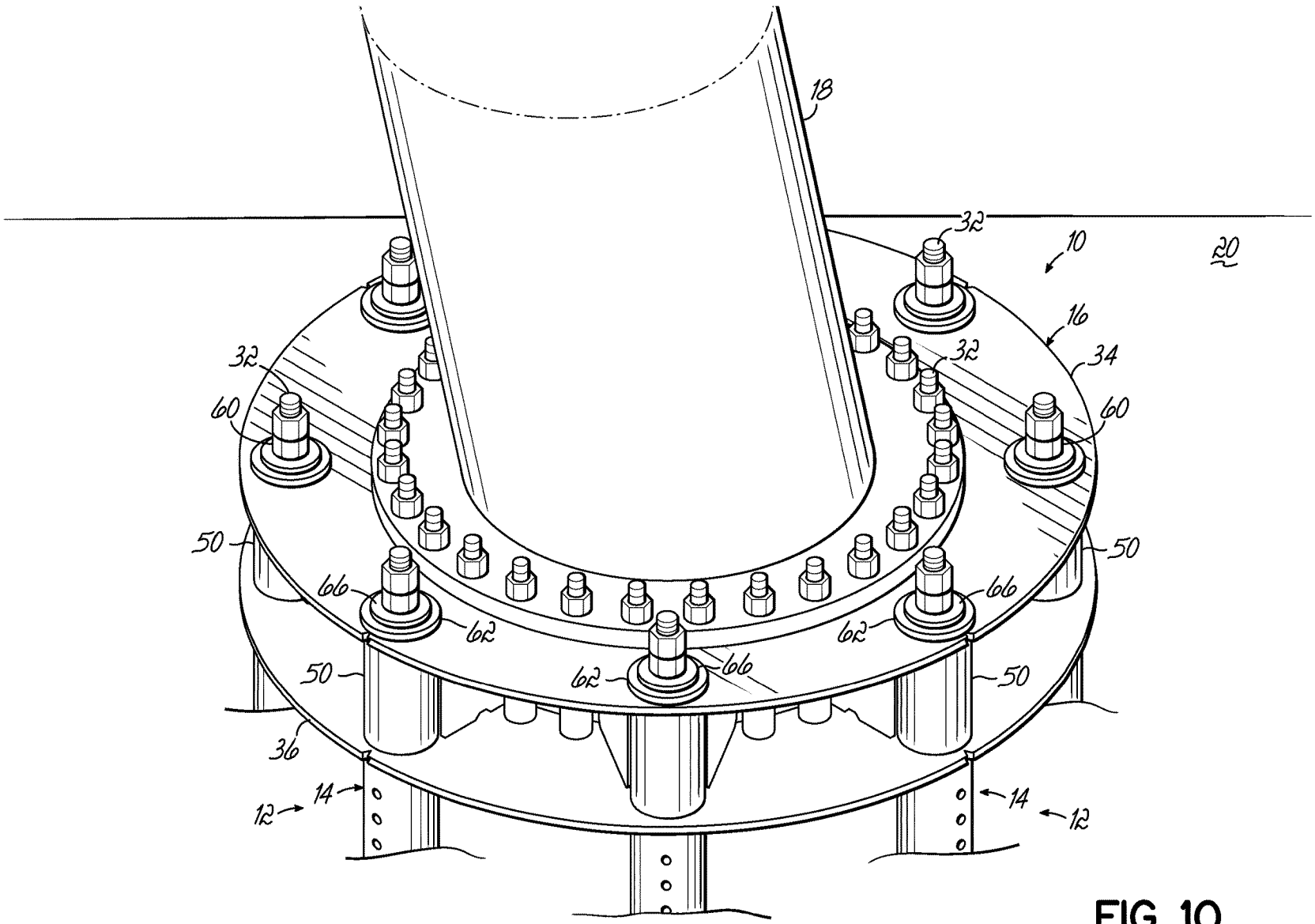
FIG. 10 is a close-up pictorial view of a second embodiment of the base structure.
Figure 11:
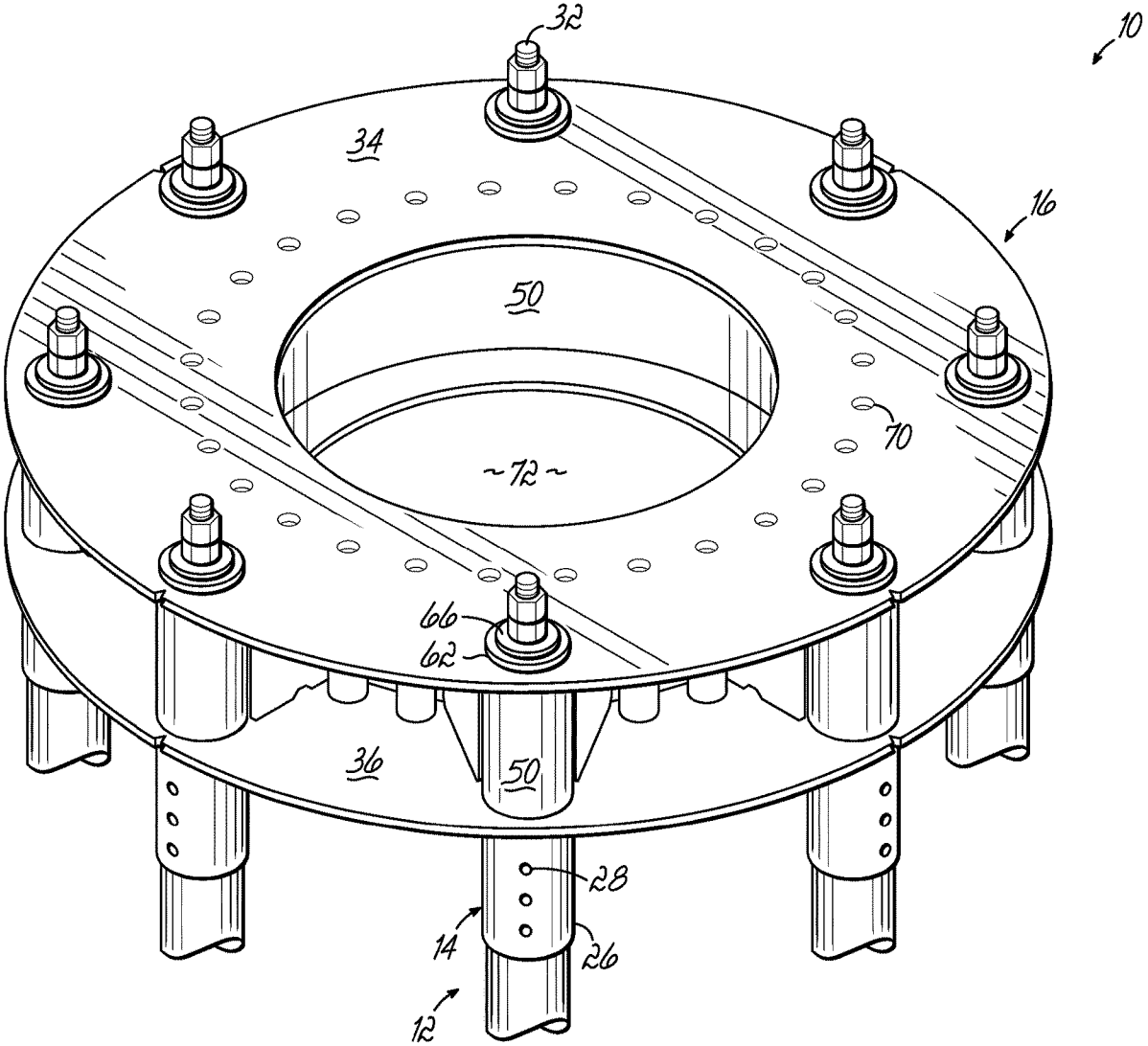
FIG. 11 is a close-up view of the base structure of FIG. 10 with the operating equipment removed for illustrative purposes.
Figure 12:
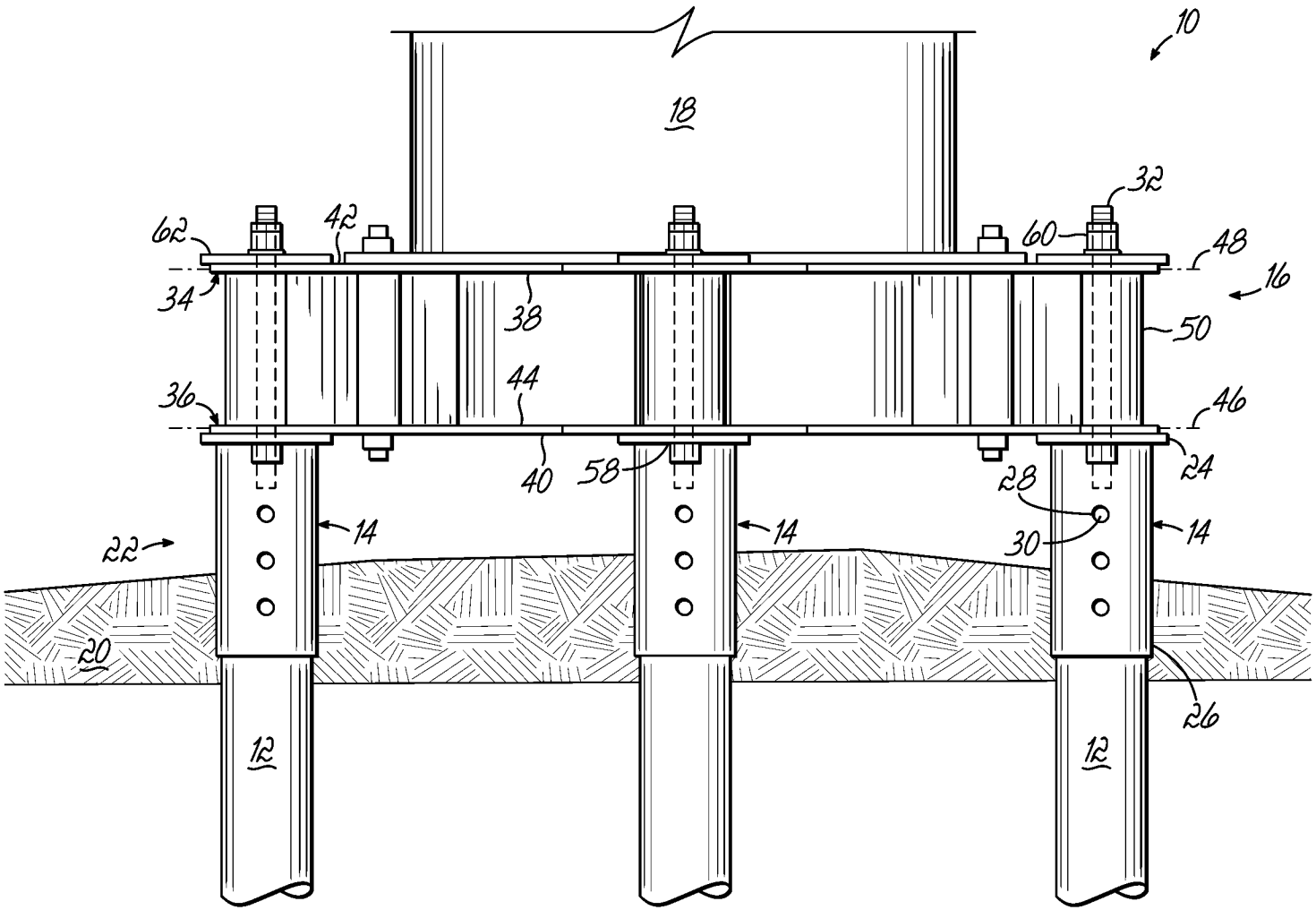
FIG. 12 is a side elevation view of the base structure of FIG. 10.
Figure 14:
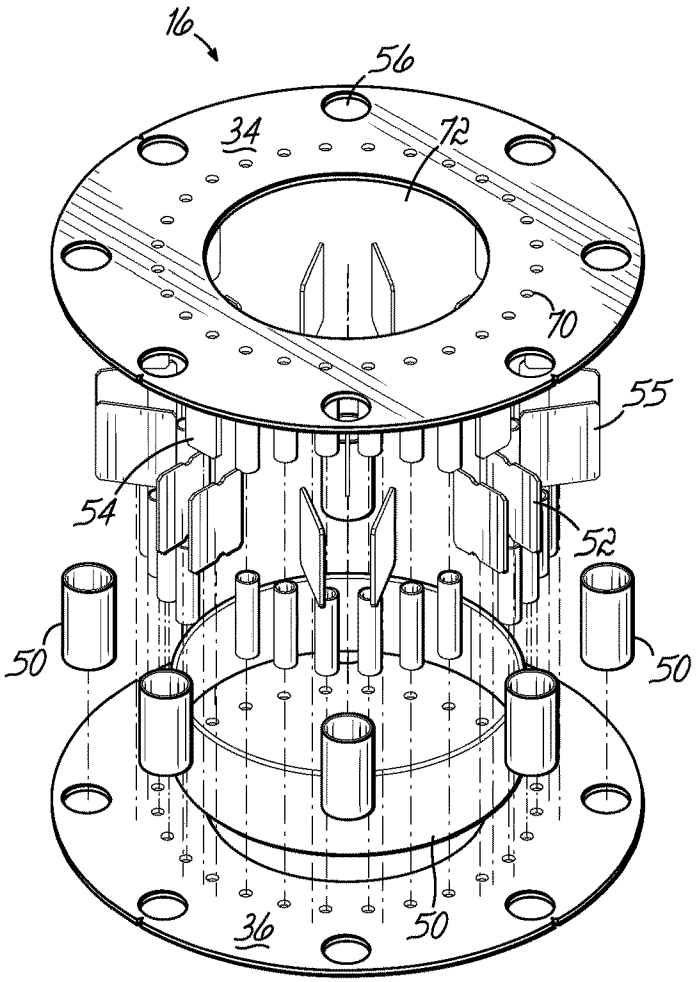
FIG. 14 is an exploded isometric view of the base structure of FIG. 10.
Figure 13:
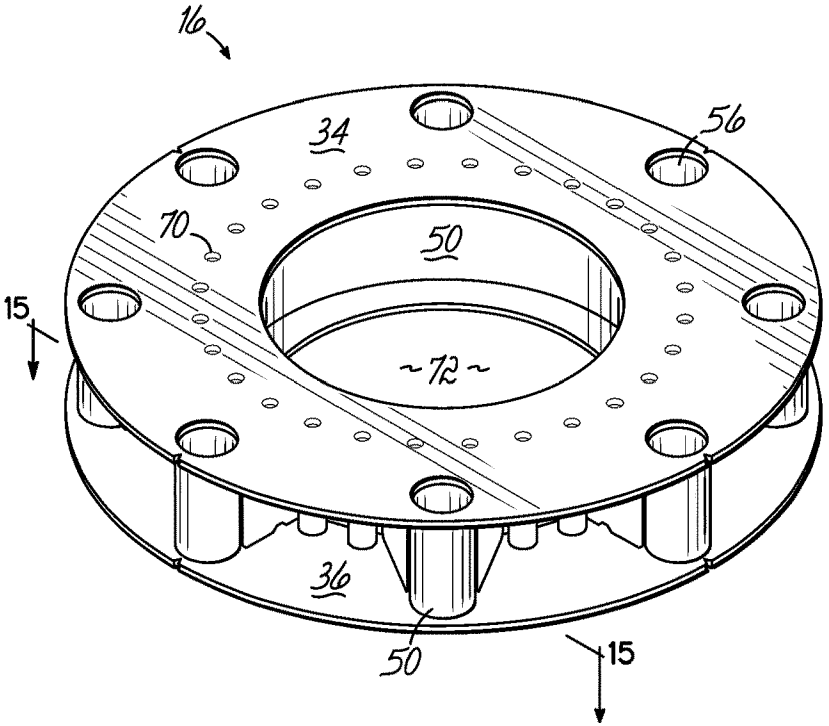
FIG. 13 is an isometric view of the base structure of FIG. 10.
Figure 15:
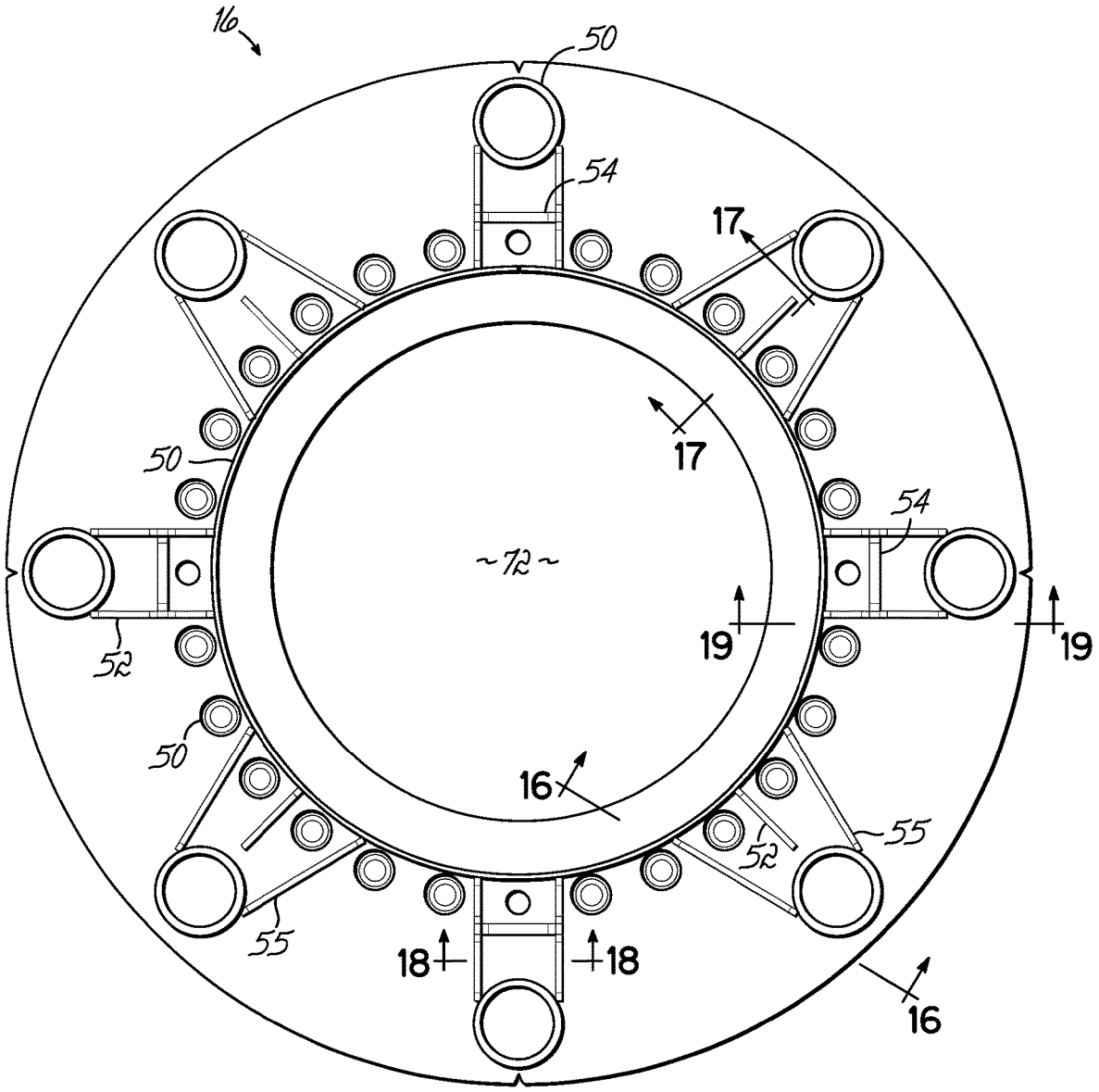
FIG. 15 is a cross-sectional view of the base structure of FIG. 10 taken along line 15-15 of FIG. 13.
Figure 16:
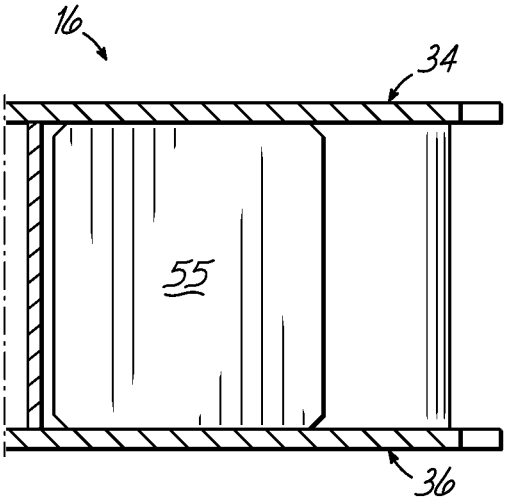
FIG. 16 is a sectional view of the base structure of FIG. 10 taken along line 16-16 of FIG. 15.
Figure 17:
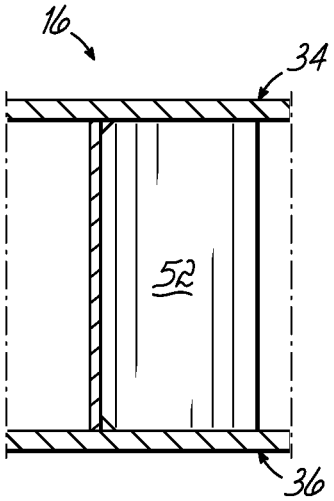
FIG. 17 is a sectional view of the base structure of FIG. 10 taken along line 17-17 of FIG. 15.
Figure 18:
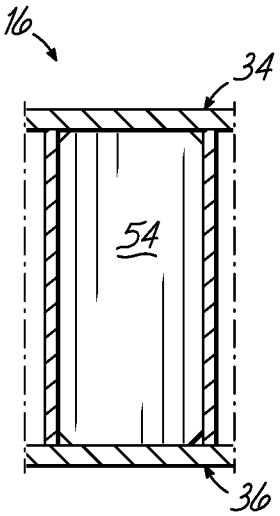
FIG. 18 is a sectional view of the base structure of FIG. 10 taken along line 18-18 of FIG. 15.
Figure 19:
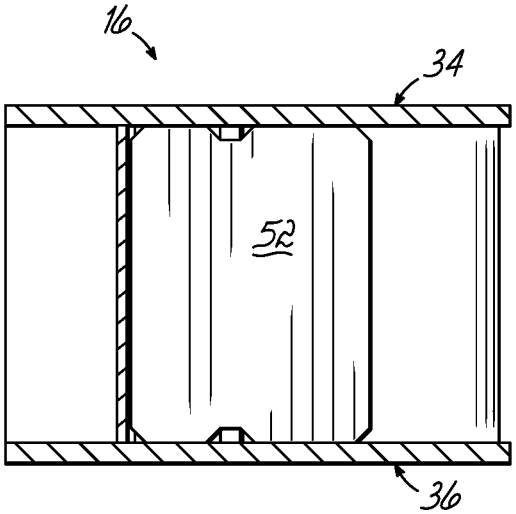
FIG. 19 is a sectional view of the base structure of FIG. 10 taken along line 19-19 of FIG. 15.

FIGS. 1, 2, and 10 show operating equipment 18 mounted to the base structure 16. In addition to operating equipment 18 being mounted generally perpendicularly to the base structure 16 (as in FIG. 2, for example), operating equipment 18 can also be mounted to the base structure 16 at an angle to the vertical, extending upwards from the upper surface 42 of the upper plate 34 (as in FIGS. 1 and 10, for example). Further, as shown in FIG. 1, neighboring piling foundation assemblies 10 may have their respective operating equipment 18 mounted at angles towards each other such that the operating equipment 18 of one piling foundation assembly 10 will intersect with the operating equipment 18 of another piling foundation assembly 10 at a distance above the ground 20. Such may be desirable if the operating equipment 18 is particularly tall (e.g., a power transmission tower or part thereof) or if the weight of the operating equipment 18 (or something supported by the operating equipment 18) is particularly great.

Referring generally to FIGS. 1-19, the piling foundation assembly 10 and accompanying operating equipment 18 may be installed as follows. First, the piles 12 are installed into the ground 20 such that free ends 22 thereof extend above the ground 20. In some cases, this may include installing a plurality of piles 12 at a generally vertical orientation in the ground 20 and/or a plurality of piles 12 at an angle to the vertical in the ground 20. The piles 12 may be helical piles having helically-arranged blades for engaging the ground 20, which is particularly suitable for some operating equipment 18 and installation environments (e.g., local geology). It will be appreciated that the principles of the present invention are also generally applicable to other pile installation configurations and other pile types (e.g., driven piles). If required, the free ends 22 of one or more of the piles 12 may require trimming to an appropriate height above the ground 20. Then, the pile caps 14 are coupled to the free ends 22 of the piles 12. The receiving sleeves 26 of the pile caps 14 are placed onto and fit around the free ends 22 of the piles 12. The pile caps 14 may then be secured to the piles 12. For example, a fastening member 32 may be installed in respective aligned sleeve apertures 28 and pile apertures 30.

After the pile caps 14 are coupled to the piles 12, the base structure 16 is positioned above the pile caps 14. The base structure 16 is moved to bring the base structure 16, and in particular the lower plate 36, into contact with the cap plates 24 of the pile caps 14. The base structure 16 is then secured to the cap plates 24. For example, a fastening member 32 may be aligned with plate apertures 56 of the upper and lower plates 34, 36 and cap plate aperture 58. The operating equipment 18 may then be positioned atop the base structure 16. The operating equipment 18 may be secured to the base structure 16 using fastening members 32 and the equipment apertures 70 of the upper and lower plates 34, 36. For example, the operating equipment 18 may be bolted to the base structure 16.

While the present invention has been illustrated by the description of various embodiments thereof, and while the embodiments have been described in considerable detail, it is not intended to restrict or in any way limit the scope of the appended claims to such detail. Thus, the various features discussed herein may be used alone or in any combination. Additional advantages and modifications will readily appear to those skilled in the art. The invention in its broader aspects is therefore not limited to the specific details and illustrative examples shown and described.

Accordingly, departures may be made from such details without departing from the scope of the general inventive concept. For example, although the base structure 16 and free ends 22 of the piles 12 are shown as being secured to each other via pile caps 14, in some embodiments, the free ends 22 of one or more of the piles 12 or the pile caps 14 may be secured, such as by welding, directly to the base structure 16, such as to the upper and lower plates 34, 36 thereof. Further, while it is contemplated that some or all of the components of the pile caps 14 and the base structure 16 may be formed of steel, they may also be constructed of any other suitable (e.g., as determined based on the environment the piling foundation assembly 10 is to be installed in and the operating equipment 18 to be supported by the base structure 16) other material or materials, such as concrete.

What is claimed is:

1. A piling foundation assembly for supporting operating equipment, the assembly comprising:

a plurality of piles installed into a ground, each pile of the plurality of piles including a free end that extends above the ground;

a pile cap coupled to the free end of each of the piles;

a base structure configured to support the operating equipment, the base structure comprising:

an upper plate, the upper plate configured to receive the operating equipment on a surface thereof;

a lower plate, the lower plate spaced a distance below the upper plate; and a plurality of webs connecting the upper plate and the lower plate, wherein the base structure is attached to the free ends of the plurality of piles; and a fastening member extending through the upper plate, one of the plurality of webs, the lower plate, and one of the pile caps for securing the base structure on at least one of the plurality of piles.

2. The assembly of claim 1, wherein each of the pile caps further comprises:

a receiving sleeve, the receiving sleeve configured to surround and receive the free end of the pile; and a cap plate, the cap plate affixed atop the receiving sleeve and configured to receive the base structure thereon.

3. The assembly of claim 2, wherein the upper plate and the lower plate each include at least one plate aperture therethrough, wherein the web through which the fastening member extends is a cylindrical web that surrounds the at least one plate aperture of the upper plate and the lower plate, and wherein each cap plate includes a cap plate aperture.

4. The assembly of claim 3, wherein the fastening member is threaded through: the cap plate aperture, the at least one plate aperture of the lower plate, the cylindrical web, and the at least one plate aperture of the upper plate to attach the base structure to the pile.

5. The assembly of claim 4, wherein a pair of washers are positioned around the fastening member above the at least one plate aperture of the upper plate to aid in attaching the base structure and to the pile, and wherein the pair of washers includes a first washer and a second washer positioned on top of the first washer, the first washer having a slot and the second washer having a central aperture.

6. The assembly of claim 1, wherein the upper plate and the lower plate each include a plurality of equipment apertures, each equipment aperture of the plurality of equipment apertures configured to receive a fastener for securing the operating equipment to the base structure.

7. The assembly of claim 1, wherein the operating equipment is a power transmission tower or a portion thereof.

* * * * *